US006045083A

United States Patent [19]

Mann et al.

[11] Patent Number: 6,045,083

[45] Date of Patent: Apr. 4, 2000

[54] STRAND GUIDE EYE AND METHOD OF WINDING A PACKAGE USING THE SAME

[75] Inventors: Douglas Brian Mann, Evans, Ga.; Eugene Vance Galloway, Anderson, S.C.

[73] Assignee: Owens Corning Fiberglas Technology, Inc., Summit, Ill.

[21] Appl. No.: 09/240,236

[22] Filed: Jan. 29, 1999

[51] Int. Cl.[7] ..... B65H 54/28

[52] U.S. Cl. ..... 242/477.1; 242/476.7; 242/157.1

[58] Field of Search ..... 242/477.1, 477.3, 242/476.7, 478, 157.1

[56] References Cited

U.S. PATENT DOCUMENTS

| | | | |
|---|---|---|---|
| 1,083,005 | 12/1913 | Desautels et al. . | |
| 2,096,316 | 10/1937 | Beran | 242/476.7 X |
| 2,130,121 | 9/1938 | Dunleavy | 242/477.1 |
| 3,171,608 | 3/1965 | Speakman | 242/477.3 |
| 3,365,145 | 1/1968 | Klink et al. | 242/478 X |
| 3,814,339 | 6/1974 | Hudson . | |
| 3,819,122 | 6/1974 | Genson . | |
| 3,934,831 | 1/1976 | Bruggisser et al. | 242/477.3 |
| 3,966,133 | 6/1976 | Gelin . | |
| 3,998,404 | 12/1976 | Reese . | |
| 4,049,209 | 9/1977 | Bach et al. . | |
| 4,050,639 | 9/1977 | Jackson . | |
| 4,061,285 | 12/1977 | Powers . | |
| 4,085,901 | 4/1978 | Sanders . | |
| 4,167,252 | 9/1979 | Klink et al. . | |
| 4,192,128 | 3/1980 | Vetterli . | |
| 4,204,649 | 5/1980 | Bosman | 242/477.1 |
| 4,208,016 | 6/1980 | Jones et al. . | |
| 4,300,728 | 11/1981 | Andre et al. . | |
| 4,349,365 | 9/1982 | Matteson . | |
| 4,383,653 | 5/1983 | Nakazawa et al. | 242/477.3 |
| 4,474,337 | 10/1984 | Schiminski et al. . | |
| 4,674,694 | 6/1987 | Hasegawa et al. . | |
| 4,792,104 | 12/1988 | Tate . | |
| 4,986,483 | 1/1991 | Ryu et al. . | |
| 5,690,150 | 11/1997 | Huey et al. . | |
| 5,731,084 | 3/1998 | Smith . | |
| 5,756,149 | 5/1998 | Smith . | |
| 5,762,277 | 6/1998 | Uedinger et al. . | |
| 5,806,775 | 9/1998 | Smith et al. . | |
| 5,839,678 | 11/1998 | Huey et al. . | |
| 5,853,133 | 12/1998 | Smith . | |

*Primary Examiner*—Donald P. Walsh
*Assistant Examiner*—Minh-Chau Pham
*Attorney, Agent, or Firm*—Inger H. Eckert

[57] ABSTRACT

A guide eye for use with a traverse mechanism of a strand package winder is positioned with respect to the surface of the package during the package build process so that the guide eye contacts the package surface in the larger diameter, end regions of the package. This positioning provides a minimal free length between the point at which the strands leaves the guide and the point at which the strand contacts the package surface, giving better control over the placement of the strand onto the package surface, particularly in the end portions of the package. Further, the guide eye is pressed against the package surface, slightly compressing the surface and pressing a portion of the preceding stand courses against the package. This pressure helps to fix the strand in the position in which it was laid down to reduce displacement of the strand course during the package build process.

20 Claims, 11 Drawing Sheets

STRAND GUIDE EYE AND METHOD OF WINDING A PACKAGE USING THE SAME

CROSS-REFERENCE TO RELATED APPLICATIONS

The present invention is related to the inventions of the following U.S. patent applications: Ser. No. 09/240,234, entitled "RECIPROCATING APPARATUS AND CAM FOLLOWER FOR WINDING A PACKAGE", filed Jan. 29, 1999, Attorney Docket No. 24626A; Ser. No. 08/683,014, entitled "METHOD AND APPARATUS FOR LUBRICATING CONTINUOUS FIBER STRAND WINDING APPARATUS," filed Jul. 16, 1996, now U.S. Pat. No. 5,756,149; and Ser. No. 08/680,083, entitled "APPARATUS FOR PRODUCING SQUARE EDGED FORMING PACKAGES FROM A CONTINUOUS FIBER FORMING PROCESS," filed Jul. 16, 1996, now U.S. Pat. No. 5,853,133.

TECHNICAL FIELD AND INDUSTRIAL APPLICABILITY OF THE INVENTION

This invention relates to the production of glass fibers, and in particular, to winding a glass fiber strand to form packages. More particularly, this invention relates to an apparatus and method for controlling the placement of a glass fiber strand on a package as it is being wound. The invention can be useful in the production of fiber strand products for use as a reinforcement in molded resinous articles.

BACKGROUND OF THE INVENTION

Mineral fibers are used in a variety of products. The fibers can be used as reinforcements in products such as plastic matrices, reinforced paper and tape, and woven products. During the fiber forming and collecting process numerous fibers are bundled together as a stand. Several strands can be gathered together to form a roving used to reinforce a plastic matrix to provide structural support to products such as molded plastic products. The strands can also be woven to form a fabric, or can be collected in a random pattern as a fabric. The individual strands are formed from a collection of glass fibers, or can be comprised of fibers of other materials such as other mineral materials or organic polymer materials. A protective coating, or size, is applied to the fibers which allows them to move past each other without breaking when the fibers are collected to form a single strand.

Typically, continuous fibers, such as glass fibers, are mechanically pulled from a feeder of molten glass. The feeder has a bottom plate, or bushing, which has anywhere from 200 to 10,000 orifices. In the forming process, the strand is wound around a rotating drum, or collet, to form, or build, a package. The completed package consists of a single long strand. It is preferable that the package be wound in a manner that enables the strand to be easily unwound, or paid out. It has been found that a winding pattern consisting of a series of helical courses laid on the collet builds a package that can easily be paid out. Such a helical pattern prevents adjacent loops or courses of strand from fusing together should the strand still be wet from the application of the size material. The helical courses are wound around the collet as the package begins to build. Successive courses are laid on the outer surface of the package, continually increasing the package diameter, until the winding is completed and the package is removed from the collet. A strand reciprocator guides the strand longitudinally back and forth across the outer surface of the package to lay each successive course.

FIGS. 1 and 2 show a conventional winder 5 with a strand supply 40. Fibers 43 are drawn from a plurality of orifices 42 in a bushing 41 and gathered into a strand 44 by a gathering member 45. Size is applied to coat the fibers by size applicator 46. The strand 44 is wound around a rotating collet 31 to build a cylindrical package 20.

The package, formed from a single, long strand, has a radially outer surface 21 with edge portions 22 and a central portion 23 between them. The edge portions 22 form generally right angles with the package ends. The outer surface 21 of the cylindrical package 20 is typically between about 10 cm and 40 cm long, but may be longer or shorter depending on the application. The collet 31 is rotated about an axis of rotation 33 by a motor 35. A package core 32, such as a cardboard tube is disposed on the collet to receive the strand package.

The winder 5 includes a strand reciprocator 10 that guides the strand 44 laterally back and forth across the package surface 21 to lay the strand in courses 24 on the package surface. The strand reciprocator 10 includes a cylindrical cam barrel 11 mounted for rotation and has a helical groove. A cam follower is disposed in the groove and extends outwardly from the cam. A strand guide 16 is attached to the end that extends from the cam and includes a notch formed in the strand guide 16 to hold the strand 44. Rotation of the cam causes the cam follower to follow the helical groove, thereby causing the strand guide to move laterally across the package surface, placing the strand on the package in a desired location.

The winding apparatus 30 operates as follows. The strand reciprocator 10 guides the strand 44 as it is laid on the outer surface of the package 20, which rotates in a winding direction 34. The strand 44 is held by a notch in the strand guide 16 and wound around the rotating collet 31 or a package core 32 disposed about the collet. The cam is oriented near the package and rotates about an axis generally parallel to the package axis of rotation 33. As the cam rotates, the cam follower is moved laterally by the helical groove in a direction generally parallel to the package axis of rotation 33. The helical groove is continuous, with curved ends that cause the cam follower to move to the end of the package and then reverse direction. The strand guide is attached to the cam follower and it traverses the outer surface of the package, reciprocating back and forth from end to end.

As the package builds, the outer radius increases. To accommodate the increasing package radius, the strand reciprocator 10 is mounted on an arm 12. As the package radius increases, the arm 12 moves away from the collet 31 along line 17 to maintain the desired spacing between the reciprocating mechanism and the outer surface of the package.

A schematic view of strand courses on the wound package is shown in FIG. 5. The strand courses are produced by the strand guide moving from right to left to the end of the package and then back to the right in the sequence indicated by the arrows in FIG. 5. For ease of illustration, the entire outer surface of the package is shown, as though the package were cut along a longitudinal line and laid flat, and is not drawn to scale or necessarily representative of an actual package geometry. As used herein, the term "course" is defined to mean the double helical strand path produced by winding the strand around the package while traversing the strand guide through a full traverse cycle. The traverse cycle is defined and illustrated herein as starting at the center of the package, moving to one end of the package, across the length of the package to the opposite end, and then returning to the center of the package. Thus, a first course 310 begins on centerline C of package 300 at point 311. First course 310 has segments 312, 313, 314, 315, 316, 317, and 318, with each segment representing one rotation of package 300. Segment 318 represents a partial rotation of package 300, and ends at point 319 on centerline C. The course segments along the central region 302 of the package 300 are straight segments, since the strand guide is moving laterally at a constant velocity and the package is rotating with an approximately constant tangential speed. The strand guide must slow down and change direction once it reaches the end portions 304, 306 of the package. The strand guide therefore produces a transition or turnaround strand segment at each end 304, 306 of the package (segments 313, 316). Each turnaround segment corresponds to the slowing down and turning around of the strand guide and includes an arcuate portion and adjacent straight portions. The linear velocity of the strand guide decreases along the arcuate portion to zero at a tangent point in the center of the arcuate portion (at the edge of package 300) and then increases until it reaches the steady state traverse speed at the beginning of the straight portion.

Half of a second course 320 (illustrated by broken lines) is also illustrated in FIG. 5. Course 320 begins at the end point 319 of the first course 310 and includes straight segment 321, turnaround segments 322 and 323, and straight segment 324. For ease of illustration, second course 320 is not shown on the right side of package centerline C.

It is important to accurately control the placement of the strand on the package in the desired location, and to maintain the strand in the position in which it is laid, to properly build the package. This is particularly important in the transition portions of the transition courses. One undesired artifact of insufficiently precise strand control is referred to as "stitching." Stitching occurs when a portion of the turnaround segment moves from its laid position and extends beyond the package edge. The "stitch," or loop of strand, is exposed to wear and breakage, compromising the integrity of the package and its usefulness to the end user. One of the approaches that has been used to control the placement of the strand on the package and to maintain the strand in the position in which it was placed is the roller bail.

A roller bail mechanism is disclosed in U.S. Pat. No. 5,756,149 to Smith and is illustrated in FIGS. 1 and 2. The strand reciprocator 10 includes a roller bail assembly 18 for holding the strand courses 24 in place at the edge portions 22 of the package surface 21 as the strand guide 16 changes direction. The roller bail assembly 18 includes a pair of spaced, or split, rollers 19. The rollers 19 have generally cylindrical edge ends and tapered inner ends. The cylindrical edge ends contact the package surface 21 at the edge portions 22. The tapered inner ends extend from the edge portions towards the central portion 23 of the package surface 21.

As the strand guide approaches the edge of the package 20, the strand 44 is laid on the package surface under the roller tapered inner edge of a split roller 19. The strand guide continues to move towards the edge of the package and the strand course moves between the package surface and the cylindrical edge end of the roller, which is in contact with the package surface. When the cam follower travels through the curved end of the groove, the strand guide 16 changes direction and moves away from the package edge and towards the central portion of the package 20. The contact between the roller bails and the package surface holds the strand course turnaround segment in place at the edge of the package surface 20, when the strand guide changes direction. The turnaround segment of the course tends not to move away from its position after more of the course is wound on to the package as sufficient friction is produced between the course and the package surface by the tension on the strand. Because the roller bail presses against the outer surface the package in the package's end regions, it slightly flattens the package surface in the end regions from the slightly arcuate shape it would otherwise take. The pressure of the roller bail also helps to secure to the package surface the turnaround segments of previously-laid strand courses. This further aids in retaining the turnaround segments in the positions in which they were placed.

The roller bail mechanism reduces, but does not eliminate stitching, and suffers from other drawbacks. The rollers rotate at high speeds, requiring precise bearings and careful lubrication. Since the rollers contact the surface of the package, any difference in tangential speeds of the package and rollers, or even excessive friction in the rollers' bearings, produces drag forces on the surface of the package, which can damage the strand. The rollers wear, and are expensive to replace. Another problem with the roller bail mechanism relates to strand free length.

Strand free length is defined as the distance between the point of contact of the strand on a strand guide structure and the point of contact of the strand with the package. In the winder shown in FIG. 2, the free length 47 is the portion of the strand 44 between the guide 16 and the contact point between the split rollers 19 and the package. Since the strand is very flexible, lateral forces applied to the strand by the guide eye do not directly control the position of the strand along the free length. Thus, rapid deceleration of the guide eye at the end of the cam stroke is not transmitted directly to the full free length of the strand, and the momentum of the free length can carry it beyond the intended end of the package, producing stitching. There is sufficient variability in the dynamics of this process that it cannot be fully compensated for in the control of the guide eye alone. Thus, it is desirable to reduce free length to the minimum possible value.

In another known strand reciprocator, the guide eye maintains contact with the surface of the package during winding to control the package shape. As shown in FIG. 3A, package 20 is rotated in a clockwise direction, pulling strand 44 downward through the strand guide 50. The strand guide 50 is mounted to a traversing mechanism (not shown) which reciprocally traverses the strand guide along the package. Strand guide 50 includes a package engaging portion 51 which engages the outer surface 21 of the package 20 during operation. The planar surfaces 52 of the package engaging portion 51 remain in continuous contact with the outer surface of the package as the strand guide 50 reciprocates. The strand guide 50 is mounted to a cam follower by way of a pivotal mount 55. As shown in FIG. 3B, strand 44 is engaged in slot 54 of the strand guide 50. Slot 54 is tapered so that its depth decreases from the upper end to the lower end.

Since the strand guide 50 continuously contacts and compresses the package, it can only be used when winding a package on which the strand is wound with relatively low tension and therefore which is not tightly compressed by the winding forces. The package can therefore be compressed by the strand guide at the ends (where the package would otherwise build to a larger diameter than the center, i.e. has a "dogbone" shape) to produce a cylindrical outer surface. Otherwise, the strand guide will damage the package.

Strand guide 50 also includes a "wing" portion 53, shown in FIGS. 3A–3D, which is used to guide a strand located laterally outside slot 54 into engagement with the slot 54. This feature is used at the initiation of winding a new package by guiding the strand into the region traversed by the strand guide, which will engage the strand on the wing portion and then urge it into the slot.

The traverse mechanism shown in FIGS. 3A–D also has substantial free length, between the edge of the slot where the strand exits the slot 54 and the strand's contact point with the package surface. As noted above, this traverse mechanism is also useful only with packages wound with low tension and therefore susceptible to compression at the ends to produced a cylindrical package.

The shape of the packages produced by, and the engagement with the packages by, the traverse mechanisms described above are illustrated in FIGS. 4A, 4B. In both mechanisms, the traverse mechanism remains in continuous contact with the package during operation (the roller bail in FIG. 4A and the strand guide in FIG. 4B.

FIG. 4A shows the relationship between the split rollers 19 of the winding mechanism shown in FIGS. 1 and 2 and a package 20. A split roller 19 is positioned at each end portion 22 of the package 20. As previously discussed, some packages tend to develop a "dog-boned" shape as they are wound, particularly those packages with high winding speed and tensions and therefore high, uniform density. The radial force applied by the split rollers 19 against the ends of the package 20 slightly flattens the end portions 22. FIG. 4B shows the relationship between the strand guide of FIGS. 3A–3D and a package 20 that is being wound. The strand guide 50 remains in continuous contact with the outer surface of the package 20 as it reciprocates in the directions of the arrows as shown. As discussed above, strand guide 50 flattens any "dog-boning" that develops on the package 20. The result is a package with a uniform outer surface diameter as shown in FIG. 4B.

SUMMARY OF THE INVENTION

The shortcomings of the prior art are overcome by the guide eye and method of winding of the invention. The guide eye is positioned with respect to the surface of the package during the package build process so that the guide eye contacts the package surface in the larger diameter, end regions of the package. This positioning provides a minimal free length between the point at which the strands leaves the guide and the point at which the strand contacts the package surface, giving better control over the placement of the strand onto the package surface, particularly in the end portions of the package. Further, the guide eye is pressed against the package surface, slightly compressing the surface and pressing a portion of the preceding stand courses against the package. This pressure helps to fix the strand in the position in which it was laid down to reduce displacement of the strand course during the package build process.

DETAILED DESCRIPTION AND PREFERRED EMBODIMENTS OF THE INVENTION

A strand reciprocator incorporating the principles of the invention is illustrated in FIGS. 6–8B. The disclosed strand reciprocator improves the control over the placement and retention of the strand in the desired location on the package, particularly in the end portions of the package, by reducing the free length of a strand that is being wound and by urging against the surface of the package the turnaround segments of previously-laid courses.

Figure 6:
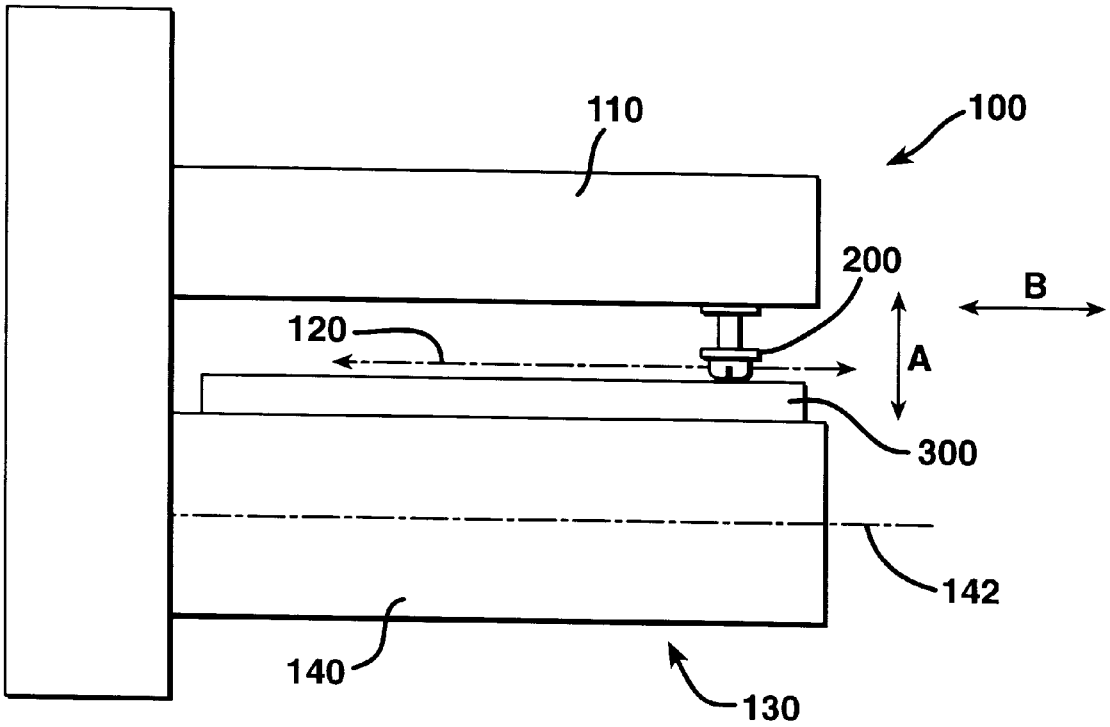
FIG. 6 is a schematic view of a winder with a guide eye embodying the principles of the invention.

As shown in FIG. 6, the winder 100 includes a winding mechanism 130 for winding a package 300, and a strand traverse mechanism 110, which reciprocally traverses a strand guide eye 200.

The winder mechanism has a collet 140 onto which package 300 is wound in a known manner (note that only a portion of the package 300 is shown for simplicity of illustration). Collet 140 rotates about a wind axis 142, which is coaxial with the longitudinal axis of the package 300.

Traverse mechanism 110 imparts reciprocal, linear motion to the guide eye 200 along a traverse path 120 to direct the strand along the package 300. Preferably, the traverse path 120 is linear and aligned in an axial direction, designated by arrow "B," which is parallel to wind axis 142. Traverse mechanism 110 maintains guide eye 200 in a fixed orientation with respect to the tangential direction of the package (the direction of a line drawn tangent to the outer surface of the package and perpendicular to the wind axis 142).

As a strand is wound onto the package 300, the outer diameter of the package 300 increases. To accommodate the package growth, the traverse mechanism 110 may be moved away from the package along a lateral axis, as designated by arrow "A." Since the strand is typically supplied at a constant mass rate to the package, the growth of the package in a radial direction may be calculated as a function of time, and the controls for the winder programmed in known fashion to move the traverse mechanism 110 in the "A" direction at the rate required to maintain the guide eye in the desired position relative to the surface of the package.

Guide eye 200 is shown in FIGS. 7A–E. Guide eye 200 is mounted to traverse mechanism 110 and is used to lead a strand along a package as the traverse mechanism traverses the guide eye with respect to the package. Guide eye 200 has a generally rectangular body 210, a mounting portion 225 by which the body can be coupled to traverse mechanism 110, and a strand guide 250.

Guide eye body 210 has a traverse axis disposed parallel to the longitudinal axis of the package (identified by arrow "B" in FIG. 6) and a tangential axis perpendicular to the traverse axis and parallel to the direction of a tangent to the package when the guide eye 200 is positioned in operative relationship with the package 300.

A guide slot 230 is formed in body. Slot 230 guides a strand as the guide eye 200 moves along the package. Slot 230 has two opposing side walls 231, 232 and an end wall 237 at which the side walls 231, 232 terminate. Preferably, the side walls 231, 232 are substantially perpendicular to the traverse axis of the guide body 210.

Figure 7D:
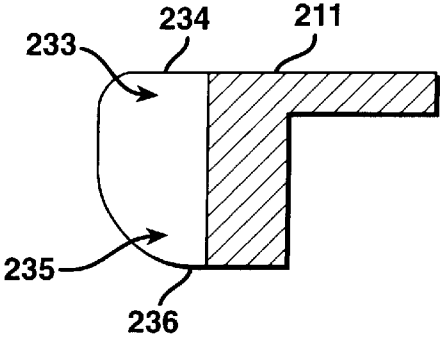
FIGS. 7A–E are top, front, side, cross-sectional, and isometric views of the guide eye of FIG. 6.
Figure 7C:
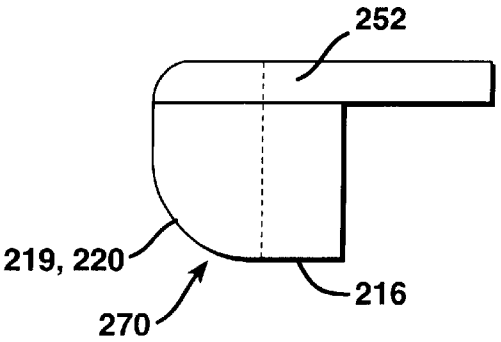
Figure 7A:
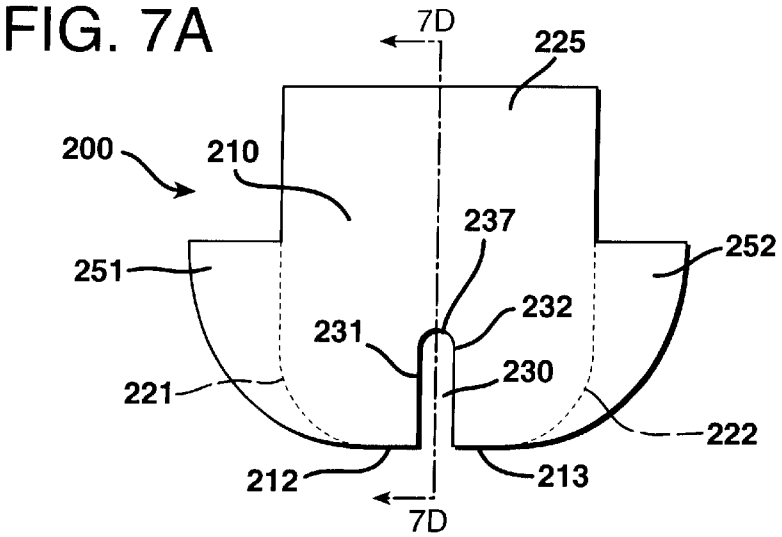
Figure 7B:
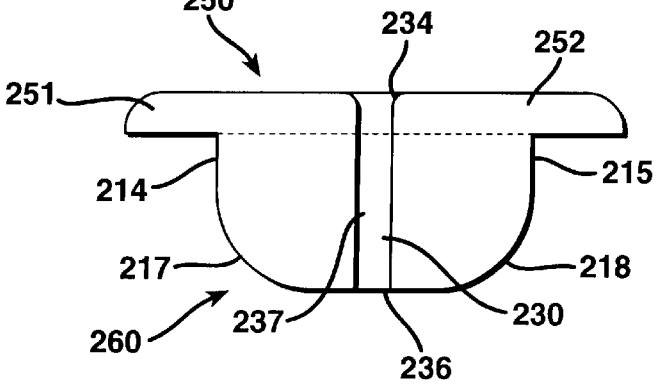
Figure 7E:
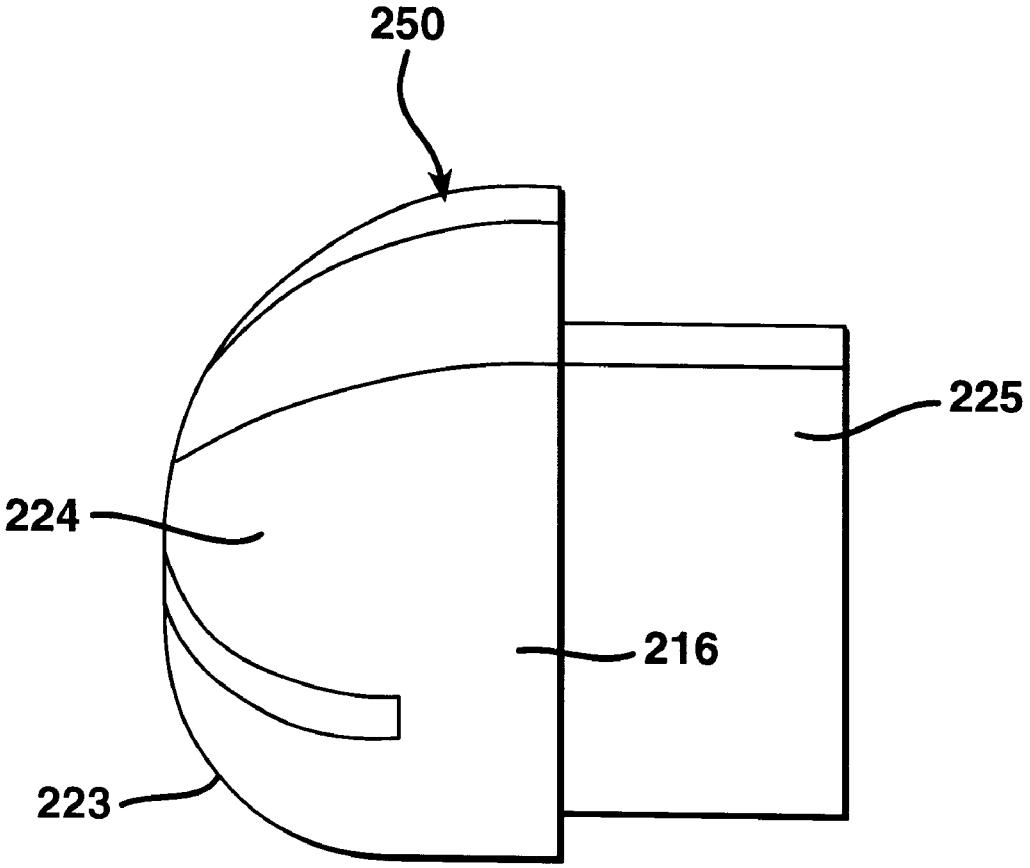

As shown in FIG. 7B, slot 230 extends from the top to the bottom of the guide eye 200, and includes an entry portion 233 adjacent to top face 211 and an exit portion 235 adjacent to the bottom face 216, of the guide eye 200. The entry 233 and exit 235 portions include rounded corner portions 234, 236, respectively, to reduce the risk of damage to a strand as it travels through slot 230.

As shown in FIGS. 7A and 7B, strand guide 250 includes left and right wing portions 251, 252. The wing portions can direct a strand on either side of the guide eye 200 into the slot 230. When a strand is outside of the slot 230, the guide eye 200 is moved linearly so that the strand engages a wing portion 251, 252. As the guide eye 200 continues to move, the strand rides along the outer surface of one of the wing portions, eventually entering the slot 230.

Guide eye body 210 has several planar faces, transition portions, and spherical radiused portions. These faces and portions may be used as surfaces for engaging the package and/or portion of the strand. Each of the transition portions and the spherical portions provide arcuate surfaces that are sufficiently radiused so as not to damage the package or strand when in contact with either of them when the package is rotating and the guide eye is being traversed by the traverse mechanism.

End faces 212, 213 and side faces 214, 215 are substantially planar surfaces of guide eye body 210, as shown in FIGS. 7A and 7B. Transition portions 217–222 are disposed on the guide eye body 210. Each transition portion includes an arcuate surface that provides a smooth transition between adjacent, substantially perpendicular planar surfaces. Generally cylindrical side to bottom transition portions 217, 218 are located between side faces 214, 215 and bottom face 216, as shown in FIG. 7B. Front to bottom transition portions 219, 220 (see FIG. 7C) and front to side transition portions 221, 222 (see FIG. 7A) similarly provide generally cylindrical transitions between adjacent planar sides.

Preferably, the guide eye body 210 also has spherical radiused portions 223, 224 disposed thereon. These spherical portions 223, 224 are located at the intersection of the transition portions described above and are best shown in FIG. 7E.

Any of the faces and portions on the guide eye body 210 described above can serve as a package engaging portion 260 and/or a strand engaging portion 270 depending on the orientation of the guide eye 200 with respect to the package 300. Preferably, the package engaging portion 260 and the strand engaging portion 270 are sufficiently radiused to avoid damage to a strand or the package when in contact with either of them. When a portion of the strand is pressed against the package, its cross-sectional shape is flattened. The arcuate surfaces of the package and strand engaging portions extend at least to the end wall 237 at the exit portion of the slot 230.

The guide eye 200 is preferably formed to Micarta, which is a linen-reinforced phenolic resin, because it is resistant to abrasion by, and does not abrade, glass fibers, wears gently and over a long period of time. However, other suitable materials will be apparent to the artisan. The guide eye may be molded from Micarta and the mounting portion of the guide eye inserted into a mold for a cam follower, which may then be molded around the inserted mounting portion of the guide eye.

As an example of dimensions for a guide eye according to the principles of the invention, for winding a package of G75 fibers with an inside diameter of 16.5 cm, an outside diameter of 26 cm, and a length of 11.5 cm, the guide eye dimensions are as follows:

width of the strand guide=0.8 inches radius of curvature of the wing portions=0.3 inches radius of curvature of the end wall of the slot=0.03 inches width of the mounting portion=0.5 inches body length from end faces to the end of the mounting portion=0.525 inches width of slot between the side walls=0.05 inches radius of curvature of the spherical radiused portion=0.15 inches height of the guide eye body from top to bottom=0.288 inches radius of curvature of the front of the strand guide=0.062 inches height of the mounting portion=0.063 inches length from end faces to rear end of bottom face=0.3 inches The relative dimensions of the guide eye may be varied depending on the strand material being wound.

Turning to the operation of the guide eye, an exemplary schematic of the engagement of the guide eye 200 and a package 300 is shown in FIG. 8A. For ease of illustration, the guide eye 200 and the package 300 are not drawn to scale and only some portions are shown.

The package 300 rotates in a clockwise direction as shown by the arrow. As a result, the rotation of the package 300 pulls strand 44 in a downward direction. The angle between the path of the strand 44 to the tangent point P on the surface of package 300 and a vertical line perpendicular to the axis of rotation of the package is designated as $\alpha$. In the illustrated example, the angle $\alpha$ is preferably 15.6° at the start of winding, and decreases as the package grows.

Figure 8:
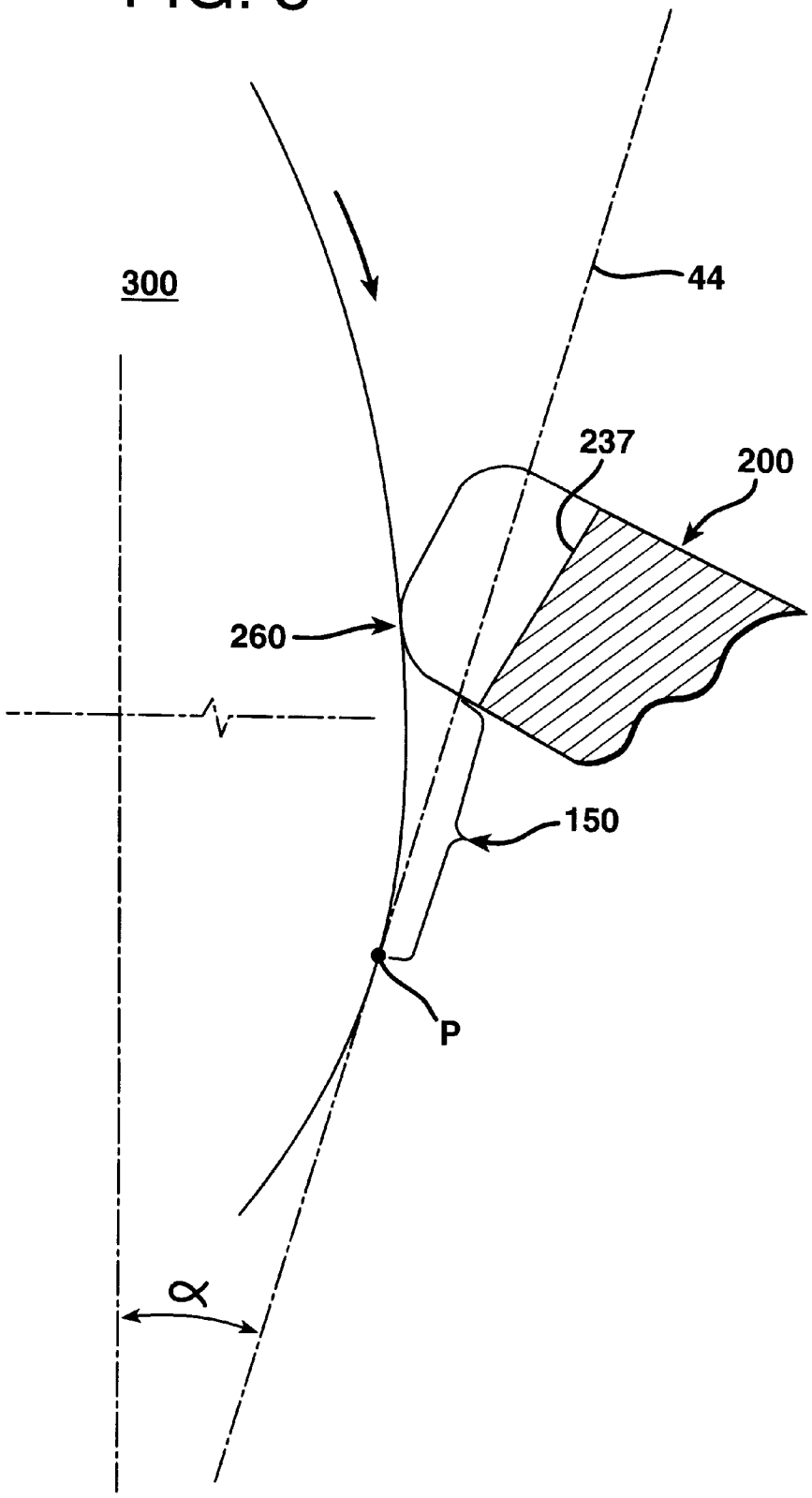
FIG. 8 is an enlarged end view of the package and guide eye of FIG. 6.

As shown in FIG. 8, the strand 44 preferably traverses the approximate center of slot 230 and without contacting end wall 237. FIG. 8 also shows the guide eye 200 engaging the package 300 with package engaging portion 260. As discussed above, package engaging portion 260 is not fixed on the guide eye 200 since different points on the guide eye 200 will contact the package 300 during winding due to the changing shape of the package.

Figure 1:
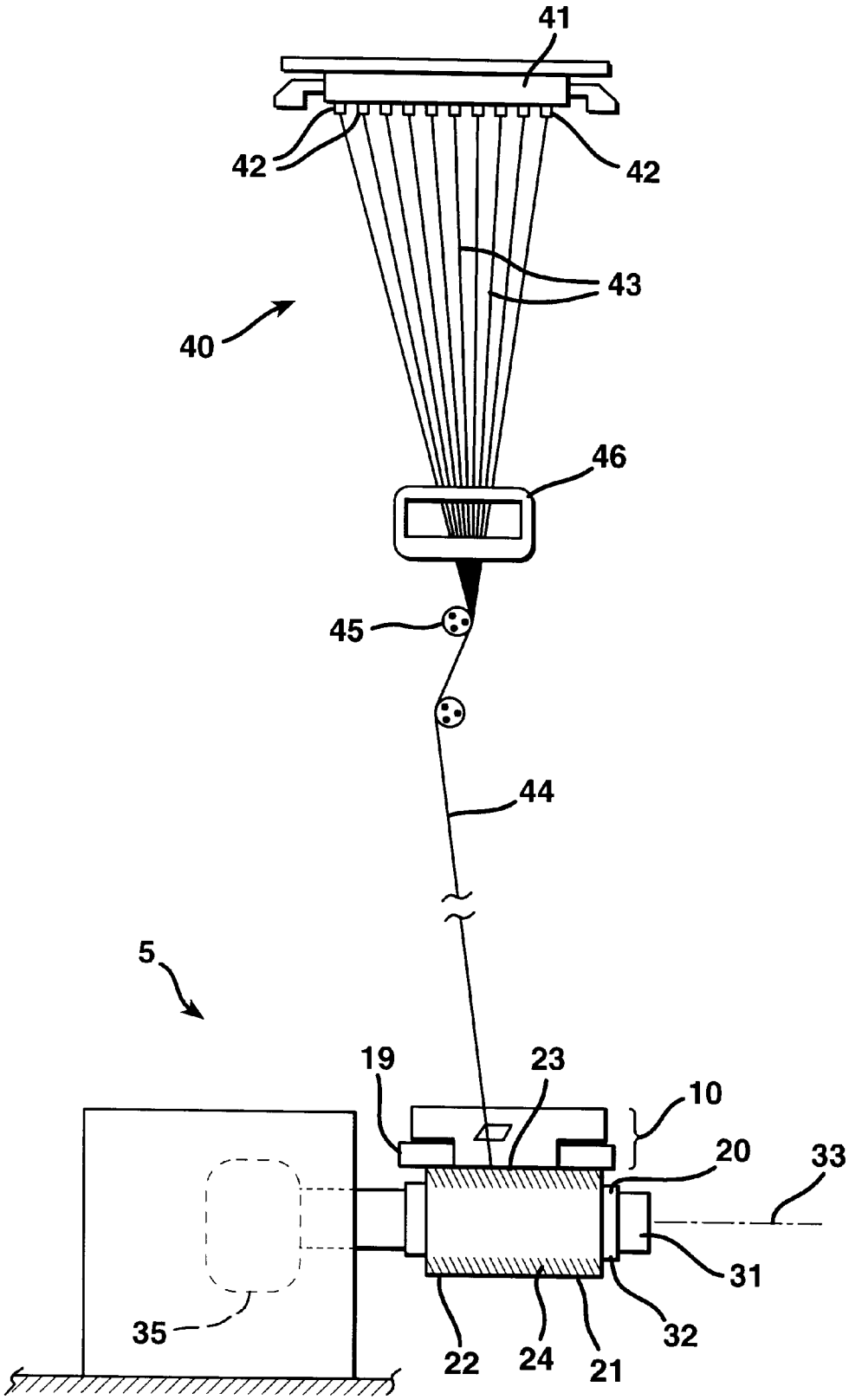
FIG. 1 PRIOR ART
FIG. 1 is a schematic view in elevation of a known apparatus for forming, collecting and winding fiber strands.
Figure 2:
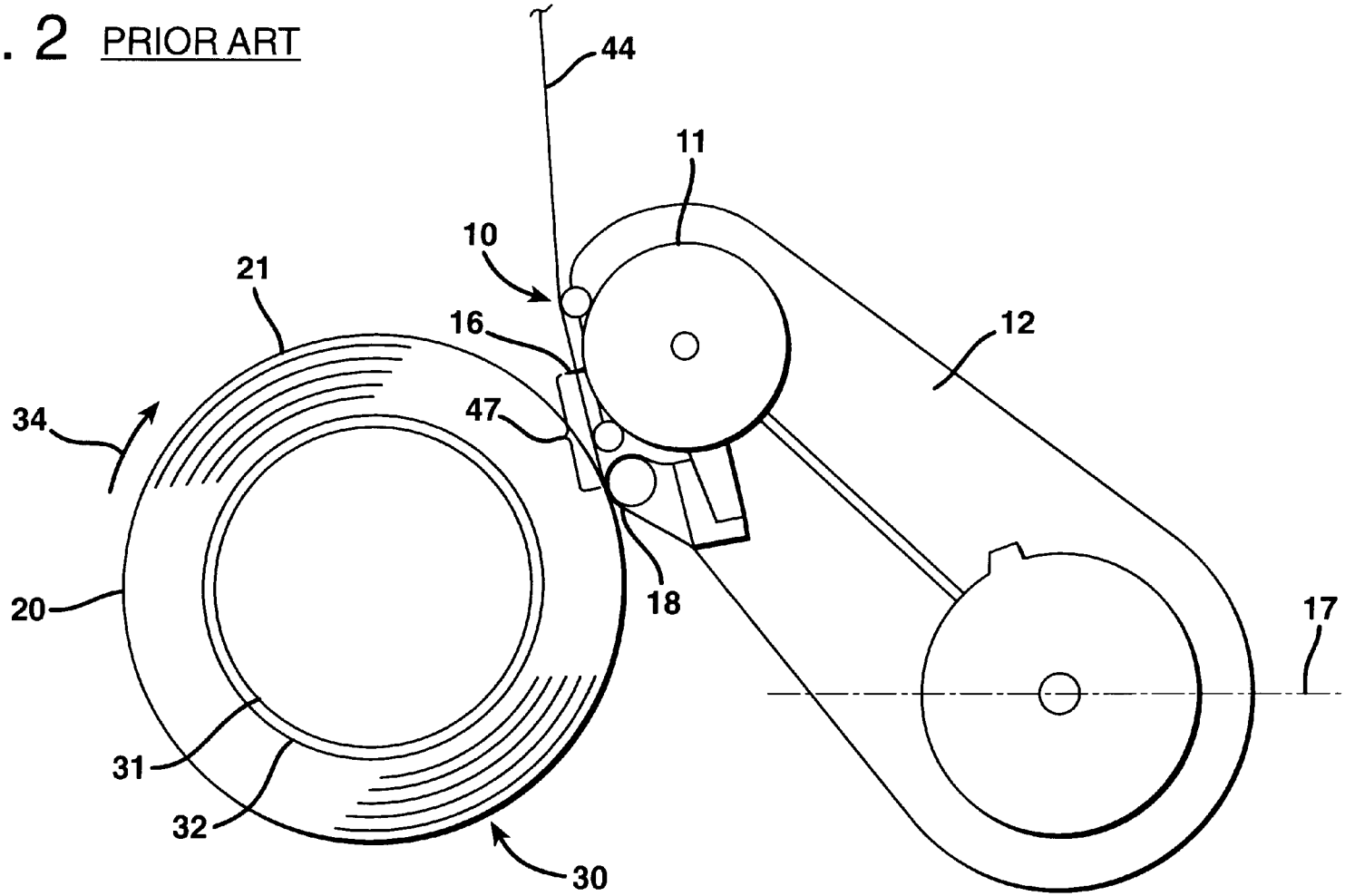
FIG. 2 PRIOR ART
FIG. 2 is an enlarged, schematic view in elevation of the strand reciprocator shown in FIG. 1.
Figure 3A:
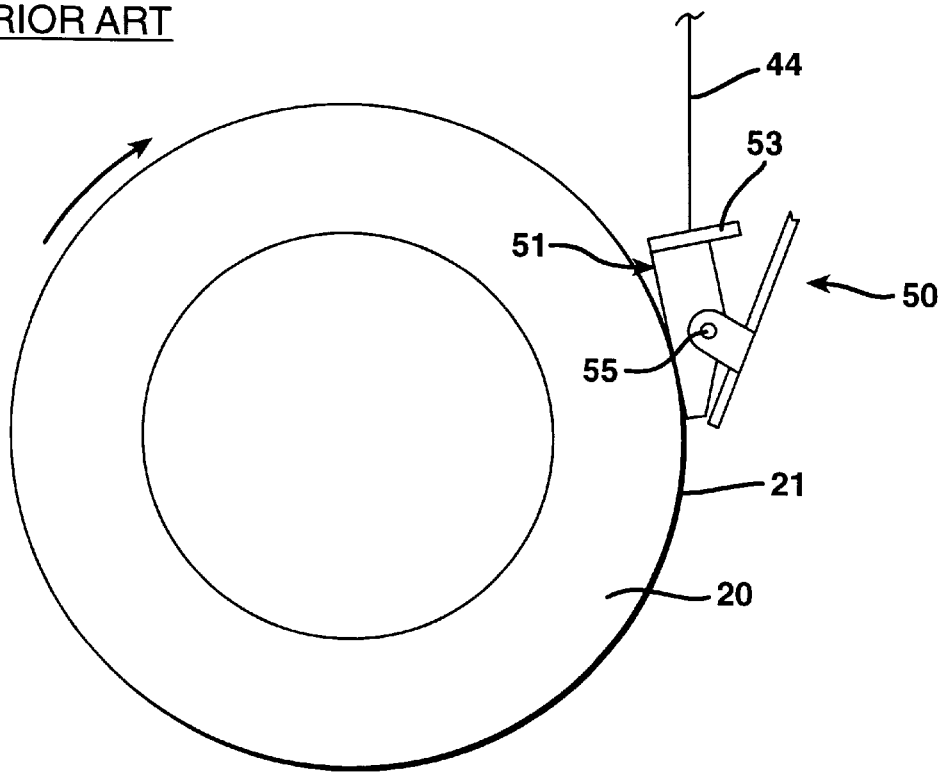
FIG. 3A PRIOR ART
FIGS. 3A–D are side, cross-sectional, top, and bottom views, respectively, of another known strand reciprocator.
Figure 3B:
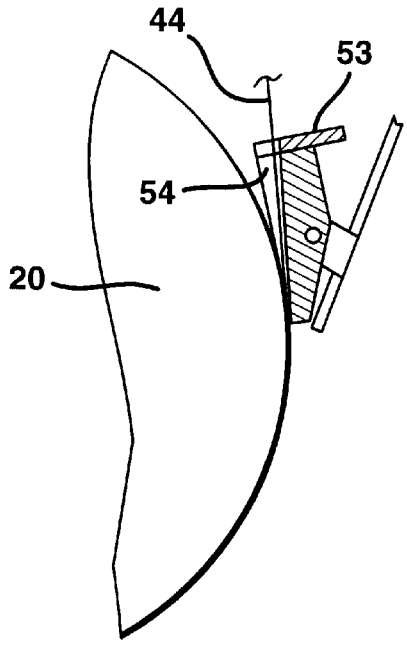
FIG. 3B PRIOR ART
Figure 3C:
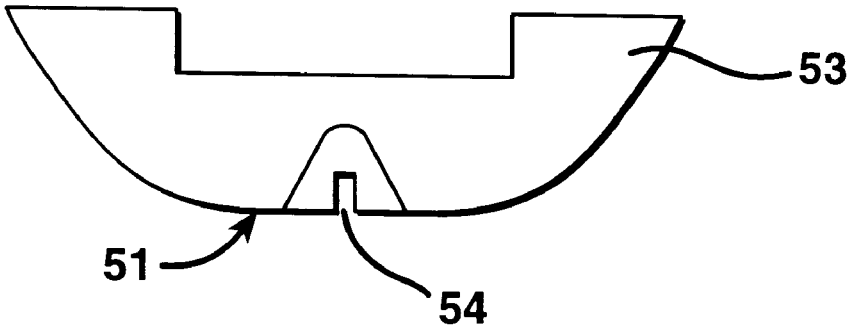
FIG. 3C PRIOR ART
Figure 3D:
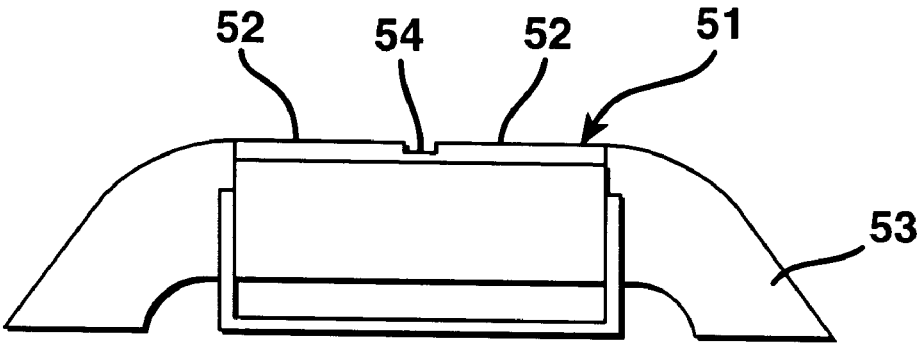
FIG. 3D PRIOR ART
Figure 4A:
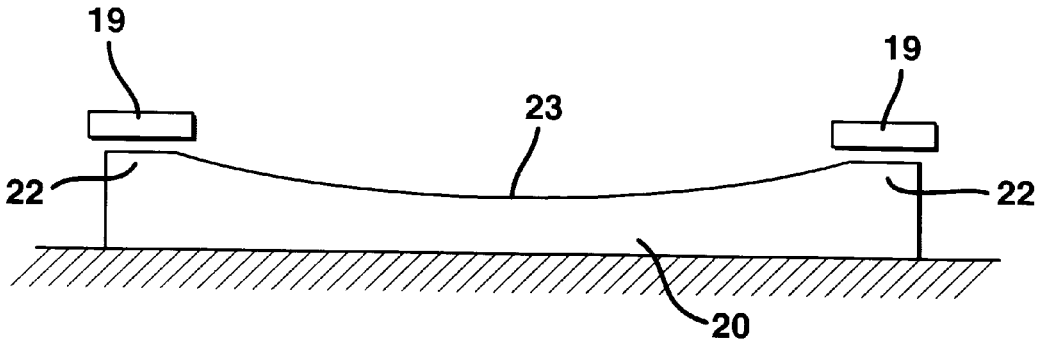
FIG. 4A PRIOR ART
FIGS. 4A–B are schematic side views showing the operative relationships of known rollers and strand guides with packages.
Figure 4B:
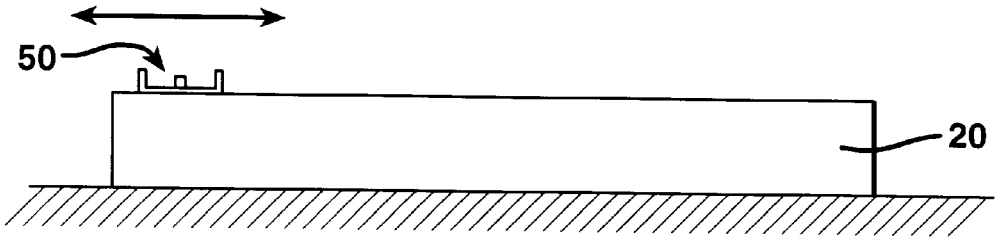
FIG. 4B PRIOR ART
Figure 5:
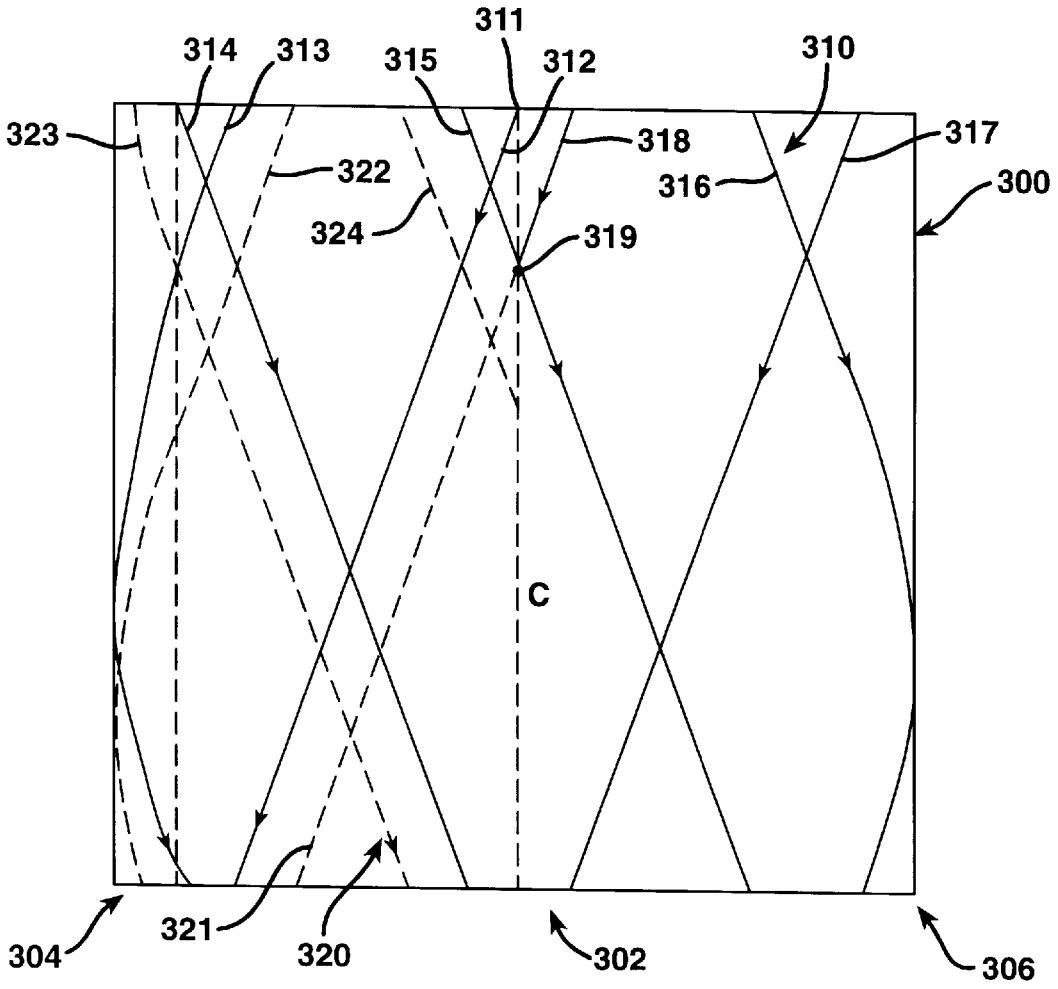
FIG. 5 is a schematic showing different strand courses on a wound package.

As discussed above, one objective of the guide eye of the invention is to reduce the strand free length. In FIG. 8, the free length 150 is the distance between the point at which the strand leaves the guide eye 200 and the point P at which the strand engages the surface of the package 300. It will be apparent from a comparison of FIG. 8 with FIG. 2 that the free length is substantially shorter in FIG. 8. Depending on the relative positioning and orientation of the guide eye with respect to the package, the free length may be as little as 0.050 inches.

Figure 9A:
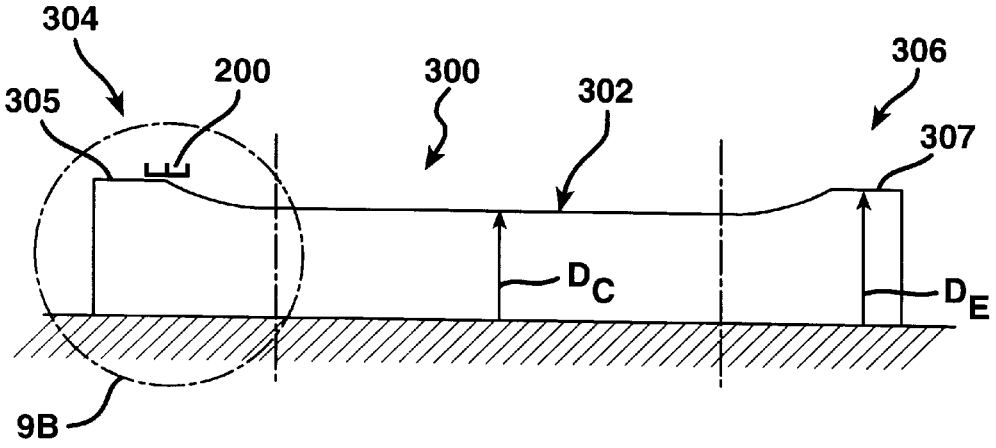
FIG. 9A is a side view showing the geometry of a package formed by the winder of FIG. 6.

FIG. 9A is a side view showing the relationship between the diameters of the end regions and the central region of a package 300. Initially, the strand is wound onto a cardboard tube on a collet. Thus, the package begins with a uniform outside diameter. However, as the strand is wound on package 300, the package naturally develops tapered end regions 304, 306 with an outside diameter $D_E$ greater than the outside diameter $D_C$ of the cylindrical central region 302 and tapered, larger-diameter end regions 304, 306. End regions 304, 306 are defined by arcuate portions of the turnaround segments, since a greater length of strand per unit length of the package is laid down the these portions, with the greatest difference occurring at the edges of the package.

Figure 9B:
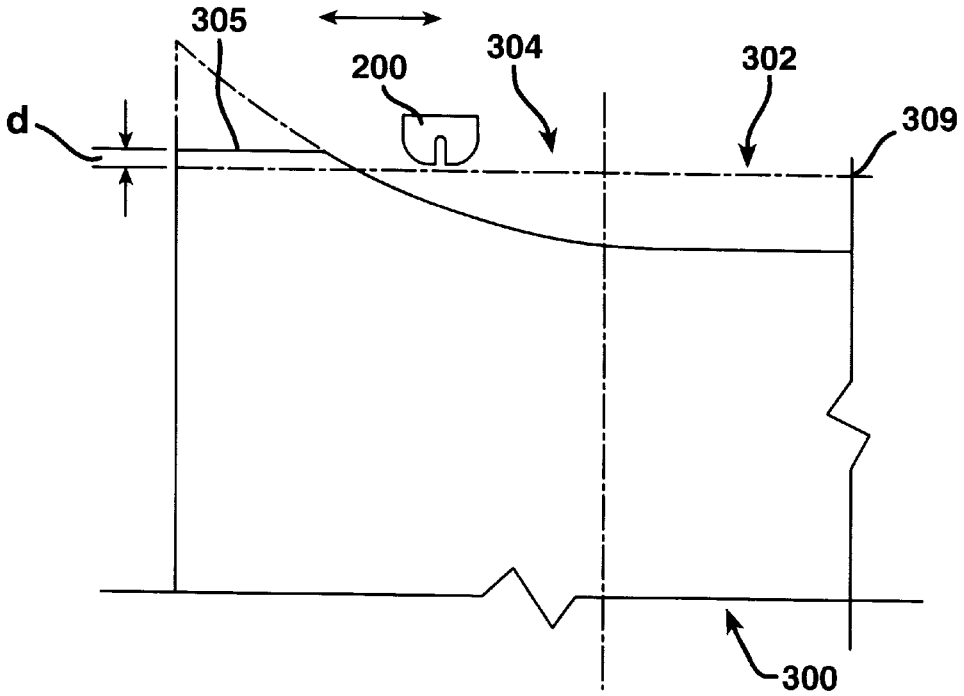
FIG. 9B is a enlarged view of an end portion of the package show in FIG. 9A.

FIG. 9B shows an enlarged view of end region 304 of package 300 and the relationship between the guide eye 200 and the package 300. Guide eye 200 traverses back and forth along the surface of the package 300, with the end faces 212, 213 of the guide eye following a line 309. The location of line 309 is selected so that guide eye 200 engages the surface of package 300 in end regions 304, 306 but not central region 302. Thus, guide eye 200 is only in intermittent contact with the outer surface of the package 300. Further, line 309 is positioned so that the package engaging portion 260 of the guide eye (not visible in this view) slightly compresses the surface of package 300. Thus, line 309 is positioned a distance d radially inwardly of the uncompressed surface of the package. In the illustrated embodiment, d is selected to be approximately 0.001 inches.

The purpose of this compressive engagement with the package surface is to press against the package surface at least the outermost, central region of the arcuate portion of the turnaround segments most recently laid down on the package. An artifact, but not necessarily an objective, of this compression is a slight flattening of the package in the end regions 304, 306, producing flattened end portions 305, 307. In FIG. 9B, flattened end portion 305 is shown by a solid line, in contrast to the shape that the end region would otherwise have taken, shown by a dashed line.

Guide eye 200 contacts the surface of package 300 with package engagement portion 260 in end regions 304, 306, engaging the package surface laterally as the guide eye traverses into the end regions. Package engagement portion 260 changes size and position on the surface of the guide eye as the guide eye engages, and then traverses, the package surface in the end region. The contact area is initially a point contact as the arcuate surfaces of the package and the guide eye meet at a tangent point, laterally offset from the center of the guide eye surface, and then grows and shifts laterally toward the center of the guide eye surface. All of the surface of the guide eye that can be part of the package engagement portion is contoured or radiused in both the traverse and tangential directions so that the engagement of the guide eye with the package surface does not damage the strand.

The artisan will appreciate that there are many possible variations on the particular embodiment described above that would be consistent with the principles of the invention. With respect to the construction of the guide eye, in the illustrated embodiment the body, mounting portion, and strand guide portions are integrally formed. However, the portions may be formed separately and coupled together. Further, the surfaces and edges that engage the strand and the package surface need not be formed on the outer surface of a unitary structure or on the same structure. Thus, any construction that disposes the requisite surfaces and edges in the appropriate relative positions is contemplated as being within the scope of the invention. While the backoff of the traverse mechanism from the package disclosed above is a programmed backoff as a function of time, other techniques of moving the guide eye away from the longitudinal axis of the package to accommodate package growth are within the scope of the invention. For example, photosensors or other detecting devices may be used to determine the relative positions between the guide eye and the outer surface of a package as part of a control feedback loop. Accordingly, a variety of techniques that allow for the winding process to continue while moving a guide eye to accommodate package growth may be used with the invention.

The extent of the package that the guide eye contacts and the compressive force with which the guide eye presses the strand may be varied depending on the desired package results. The amount that the guide eye contacts the end portions can be varied by how far the guide eye is advanced radially inwardly into the package. In other words, the farther the guide eye is advanced inwardly, the greater the portion of the arcuate portions of the turnaround segments of the strand courses it will engage in the end regions. The guide eye need not contact the surface of the end regions of the package throughout the package build. Of course, the extent to which the guide eye can press a strand is dictated in part by the properties of the material being wound.

We claim:

1. A method of winding a strand onto a package in a series of courses, each course constituting one full reciprocal traversal of the strand with respect to the axis of the package, each course including a turnaround segment with an arcuate portion, comprising the steps of:

rotating the package;

winding the strand onto the rotating package;

traversing a guide eye reciprocally along a path adjacent the package;

conducting the strand through the guide eye; and pressing against the package with the guide eye the strand only in the turnaround segments of preceding courses during at least a portion of the winding of the package.

2. The method of claim 1 wherein in the pressing step the strand is flattened in at least a portion of the turnaround segments of the preceding courses.

3. The method of claim 1 wherein said guide eye traverses along a linear path.

4. The method of claim 3 wherein said linear path is parallel to an axis of rotation of the package.

5. The method of claim 1 wherein said guide eye includes a slot, said conducting step includes conducting the strand through said slot, and said pressing step includes engaging the strand with a portion of the guide eye adjacent said slot.

6. The method of claim 1 wherein the method further comprises the step of moving the guide eye away from the package as a function of time.

7. A method of winding a strand onto a package having an outer surface having end portions with diameters larger than the diameter of the central portion, comprising the steps of:

rotating the package; and traversing a guide eye along a path adjacent the package such that the guide eye contacts the end portions and not the central portions while the package is rotating.

8. The method of claim 7 wherein the strand is wound onto the package in a series of courses, each course constituting one full reciprocal traversal of the strand with respect to the axis of the package, each course including a turnaround segment with an arcuate portion, further comprising the steps of:

conducting a strand through said guide eye; and pressing with the guide eye against the package at the end portions of the package a turnaround segment of a preceding course.

9. The method of claim 8 wherein in the pressing step the strand is flattened in the end portions of the package.

10. The method of claim 7 wherein said guide eye traverses along a linear path.

11. The method of claim 10 wherein said linear path is parallel to an axis of rotation of the package.

12. The method of claim 7 wherein said guide eye includes a slot, said conducting step includes conducting the strand through said slot, and said pressing step includes engaging the turnaround segment with a portion of the guide eye adjacent said slot.

13. A guide eye for guiding a strand onto a package rotated about an axis of rotation to distribute the strand axially along the package and circumferentially around the package, the package having an outer surface with end portions having larger diameters than an intermediate, central portion, comprising:

a body having a traverse axis disposed parallel to the axis of the package when said guide eye is disposed in operative relation to the package and a tangential axis perpendicular to said traverse axis and parallel to the direction of motion of the surface of the package at a tangent to the package when said guide eye is disposed in operative relation to the package;

a strand guiding portion formed on said body and adapted to engage the strand and guide the strand to selected positions along the axis of the package;

a package engaging portion disposed on said body, adapted to engage at least a portion of the package while the package is rotating and while the guide eye is traversed along the axis of the package, and having an arcuate surface sufficiently radiused with respect to said traverse and tangential axes to avoid damage to the strand on the package when the package engaging portion engages the package by coming into contact only with the end portions of the package surface as said guide eye is traversed along the axis of the package and the package is rotating.

14. The guide eye according to claim 13, wherein the package is rotated by a winder having a traverse mechanism and wherein the guide eye includes a mounting portion coupled to said body to mount said guide eye to the traverse mechanism.

15. The combination of the guide eye according to claim 14 and a winder having:

a rotatable collet on which a package can be mounted for rotation by the collet;

a traverse mechanism, said guide eye being mounted to said traverse mechanism; and means for moving the traverse mechanism relative to the collet so that said package engaging portion of said guide eye can be brought into engagement with only the turnaround end portions of a package rotated on said collet.

16. The combination of claim 15 wherein the means for moving the traverse mechanism comprises a processor for adjusting the distance relation of said mechanism to said package, the adjustment of the distance being calculated as a function of time.

17. The guide eye according to claim 13, wherein said guide eye further includes a strand directing portion adapted to engage a strand when said guide eye is moved in a direction parallel to the traverse axis into contact with the strand and to direct the strand into operative engagement with said strand guiding portion.

18. The guide eye according to claim 13, wherein said strand guiding portion includes a slot having side walls approximately perpendicular to said traverse axis.

19. The guide eye according to claim 18 wherein said slot has a strand entry portion and a strand exit portion, said strand exit portion being disposed adjacent said package engaging portion.

20. The guide eye according to claim 18, wherein said slot has an end wall at which said side walls terminate and wherein said arcuate surface of said package engaging portion extends at least to said end wall at said exit portion of said slot.

* * * * *